US006151041A

United States Patent [19]

Bolash et al.

[11] Patent Number: 6,151,041

[45] Date of Patent: Nov. 21, 2000

[54] LESS RESTRICTIVE PRINT HEAD CARTRIDGE INSTALLATION IN AN INK JET PRINTER

[75] Inventors: John Philip Bolash, Lexington; Darell Dean Cronch, Georgetown; Paul Harrington, III, Versailles, all of Ky.

[73] Assignee: Lexmark International, Inc., Lexington, Ky.

[21] Appl. No.: 09/175,115

[22] Filed: Oct. 19, 1998

[51] Int. Cl.[7] ..... B41J 29/393

[52] U.S. Cl. ..... 347/19; 347/43; 347/49; 347/14; 347/86

[58] Field of Search ..... 347/43, 49, 19, 347/14

[56] References Cited

U.S. PATENT DOCUMENTS

| | | | |
|---|---|---|---|
| 4,709,245 | 11/1987 | Piatt | 347/49 |
| 4,853,708 | 8/1989 | Walters | 347/86 |
| 4,907,019 | 3/1990 | Stephens | 347/86 |
| 4,930,915 | 6/1990 | Kikuchi et al. | 400/175 |
| 4,970,533 | 11/1990 | Saito et al. | 347/86 |
| 5,049,904 | 9/1991 | Nakamura et al. | 347/19 |
| 5,289,210 | 2/1994 | Takayanagi et al. | 347/14 |
| 5,363,134 | 11/1994 | Barbehenn et al. | 347/49 |
| 5,461,405 | 10/1995 | Lehmann et al. | 347/49 |
| 5,506,611 | 4/1996 | Ujita et al. | 347/86 |
| 5,627,572 | 5/1997 | Harrington, III et al. | 347/23 |
| 5,646,658 | 7/1997 | Thiel et al. | 347/49 |
| 5,668,582 | 9/1997 | Manzone et al. | 347/49 |
| 6,000,782 | 12/1999 | Lee et al. | 347/43 |
| 6,019,461 | 2/2000 | Yoshimura et al. | 347/49 |

*Primary Examiner*—John Barlow
*Assistant Examiner*—Cesar G. Lago
*Attorney, Agent, or Firm*—Luedeka, Neely & Graham, P.C.; D. Brent Lambert

[57] ABSTRACT

The invention described in the specification relates to an ink jet printer with multiple print heads that allows for the less restrictive installation of print head cartridges. The print head carriers are designed so that any of a variety of different types of print head cartridges can be inserted into any of the print head carriers. When image data is received, the ink jet printer's processor determines the appropriate type of print head cartridge that should be used to print the image data. Information electronically stored on the print head cartridges in the form of a read-only memory (ROM), bar code, or optical LED's, identifies the type of each print head cartridge. The printer processor examines this identification information on the installed print head cartridges to determine if one of the print head carriers contains the desired type of print head cartridge. If the desired type of print head cartridge is located, the printer processor configures the printer itself to print with the desired cartridge in the particular print head carrier location in which the desired cartridge was found. If the printer cannot locate the desired type of print head cartridge in any of the multiple print head carriers, a error message is displayed informing the user that the proper print head cartridge is not installed.

11 Claims, 7 Drawing Sheets

PRIOR ART

PRIOR ART

PRIOR ART

PRIOR ART

11
A
44
38
B
46
40
C
48
42

11
B
46
38
A
44
40
N
50
42

LESS RESTRICTIVE PRINT HEAD CARTRIDGE INSTALLATION IN AN INK JET PRINTER

FIELD OF THE INVENTION

The invention relates to a method and apparatus for operating an ink jet printer having multiple print head cartridges. More particularly, the invention relates to a method and apparatus for selecting a particular type of print head cartridge from among multiple print head cartridges to use in printing an image, where the selection of the particular type of cartridge is independent of the position of the cartridge among multiple print head carriers.

BACKGROUND OF THE INVENTION

Ink jet type printers typically employ print heads consisting of a reservoir of ink in fluid communication with a series of nozzles on a semiconductor substrate that are used to expel the ink onto a printing surface. The ink is drawn to the substrate through channels and then expelled through the nozzles. Some types of ink jet printers expel the ink by superheating a small portion of the ink with an electric resistor located in a chamber beneath the nozzle. The boiling ink forms an expanding bubble which propels a drop of ink through the nozzle and onto the printing surface. In other types of ink jet printers, piezoelectric transducers that change their dimensions in response to an electric field are used to essentially squeeze a drop of ink through the nozzle. The number, spacing, size and condition of the nozzle holes greatly influences the print quality. By carefully controlling the expulsion of the ink through the nozzles and onto a printing surface, a high quality image can be created. As used herein, the term "image" is meant to include anything that is to be printed, including both text and graphics. For color printing applications, the three primary colors of cyan, magenta and yellow are provided by ejecting ink through the nozzles associated with each of the primary colors.

Many ink jet printers having multiple print heads are designed to use different types of ink jet print head cartridges. For example, an ink jet printer may have a color ink print head cartridge having an ink container filled with color inks and a black ink print head cartridge having an ink container filled with black ink. An ink jet printer also may be designed to print with either a high resolution print head cartridge or a low resolution print head cartridge. A high resolution print head cartridge will typically have more nozzles than a low resolution print head cartridge. These printers operate on the assumption that a certain type of print head cartridge has been inserted into a particular print head carrier location. The drawback to these kinds of ink jet printers is that if the wrong type of print head cartridge has been inserted in a particular print head carrier location, the cartridge must be manually removed and replaced by the desired cartridge.

As the availability of different types of print heads increases, so does the complexity of determining which type print head is to be installed in which print head carrier position. Because the print head carrier location in which a print head cartridge is inserted is so important, ink jet printers having multiple print head cartridges use of variety of methods to insure that the right print head cartridge is placed is the right carrier location. Some ink jet printers have different shaped print head carriers so that only a print head cartridge with a particular shape will fit into a particular print head carrier location. Because only print head cartridges of a certain type will fit in a particular print head carrier location, the ink jet printer assumes that the correct print head cartridge is inserted in the correct print head carrier. When new types of ink jet print head cartridges are developed they usually require updated printer software and often require a new and different print head carrier.

Alternatively, some ink jet printers having multiple print head carriers place print head identification information on the print head cartridge. The printer electronics read this information to determine if the correct type of print head cartridge is installed in a particular print head carrier location. If the printer electronics determine that the wrong type of print head cartridge has been inserted into the print head carrier, the printer displays an error message to inform the user that the wrong type print head cartridge has been inserted. This approach suffers from the same shortcomings as the shaped print head carrier approach discussed above. If a new and unrecognized, or wrong type of ink jet print head cartridge is installed in a carrier location, the printer electronics will simply display an error message. The user must then manually remove the improper cartridge and replace it with the correct type of cartridge for the particular print head carrier location. Installing an ink jet print head cartridge in a print head carrier location, receiving an error message, and removing and reinstalling the print head cartridge involves some effort and may result in some confusion for an individual unfamiliar with the printer.

Additional problems arise when it is desired to print a particular set of data with a certain type of ink jet print head cartridge. If either of the approaches discussed above are used, the data must be printed with the print head cartridge installed in the appropriate print head carrier. If the print head carrier is damaged, the printer will not be able to print using the desired type of print head cartridge until the print head carrier associated with the desired type of cartridge is replaced or repaired.

SUMMARY OF THE INVENTION

To overcome the problems discussed above and to maximize user convenience, the present invention provides an efficient, inexpensive ink jet printer that has multiple print head carriers into each of which any of a variety of ink jet print head cartridges can be placed. When the printer receives a request to print a set of data with a particular type of print head cartridge, the printer electronics search each print head carrier location for a print head cartridge of the desired type. When the desired type of ink jet print head cartridge is located, the printer electronics configure the printer to print with the print head carrier location containing the desired print head cartridge. This less restrictive technique of installing the print head cartridges in an ink jet printer allows the user to simply insert different cartridges into any of the print head carriers. The printer electronics then locate the desired print head cartridge and configure the ink jet printer to use that print head cartridge.

Accordingly, it is an object of the present invention to avoid the aforementioned disadvantages of the prior art in the operation of ink jet printers having multiple print heads and to provide an ink jet printer that allows for the less restrictive installation of print head cartridges.

With regard to the above and other advantages, the invention provides a method of operating an inkjet printer that has multiple inkjet print head cartridges of multiple types installed at multiple inkjet print head carrier locations. Each inkjet print head cartridge has a storage device disposed thereon for storing identification information indicating the type of cartridge. The method involves first determining a particular type of inkjet print head cartridge to use in printing an image. Next, the method ascertains whether any of the inkjet print head cartridges installed at the multiple inkjet print head carrier locations are of the particular type. Finally, the printer is configured to print the image with the particular type of inkjet print head cartridge installed at the corresponding inkjet print head carrier location.

The aforementioned embodiment of the present invention is a substantial improvement over the prior art. Prior art systems required that specific types of print head cartridges be placed in specific print head carrier locations. By searching all of the print head carrier locations for the desired type of print head cartridge, the present invention allows for less restrictive print head cartridge installation. Instead of having to read a label or user's manual instructing the printer user on which types of print head cartridges to place where, the user simply installs the desired type of print head in any print head carrier location. The printer then searches the print head cartridges to locate the correct type of cartridge and configures itself to use the selected cartridge in whichever print head carrier location that the selected cartridge resides. Thus, the possibility of installing a print head cartridge in the wrong print head carrier location is eliminated by the present invention.

In a preferred embodiment of the invention, the step of ascertaining whether any of the inkjet print head cartridges installed at the multiple inkjet print head carrier locations is of the particular type includes first accessing the identification information stored in each of the memory devices. The method then identifies the type of print head cartridge installed at each location based upon the identification information. Preferably, if the particular type of print head cartridge is not installed in any of the print head carrier locations, an error message is displayed to a printer user.

In another aspect, the invention provides a method of operating an ink jet printer having multiple inkjet print head cartridges and multiple print head carrier locations for receiving the multiple ink jet print head cartridges. Each inkjet print head cartridge has identification information indicating a type of cartridge that is electronically stored in a memory device disposed on each cartridge. The method operates on a printer that is electrically interfaced with a host computer, and that is capable of receiving image data from the host computer. The method involves first specifying an appropriate type of print head cartridge to use to print the image data. The memory devices are accessed and the identification information is retrieved. The method then determines, based on the identification information, whether the appropriate type of print head cartridge is installed in any of the print head carrier locations. An error message is displayed if the appropriate type of print head cartridge is not installed in any of the print head carrier locations. A user is then prompted to install a print head cartridge of the appropriate type in one of the print head carrier locations. The printer is configured to print using the appropriate type of print head cartridge at the cartridge's print head carrier location, and the image data is printed using the appropriate type of print head cartridge.

In yet another aspect, the invention provides an inkjet printer for creating an image on a printing surface. The printer is capable of interfacing with a host computer, and the image is based on image data received from the host computer. The printer includes print head type determination means that receive the image data from the host computer and determine a particular type of inkjet printhead cartridge to be used in creating the image based upon the image data. The printer also includes multiple inkjet print head cartridges of different types for use in a variety of different printing situations. Each print head cartridge has identification means for storing identification information relating to the type of print head cartridge. Multiple print head carrier locations are each capable of receiving any one of the inkjet print head cartridges, and at least one location has one of the print head cartridges installed therein. The printer has print head cartridge selection means that access the identification information, determine the type of print head cartridge installed in each print head carrier location based on the identification information, and select a print head carrier location having a print head cartridge of the particular type installed therein. The printer further includes printer configuration means for configuring the printer to use the print head cartridge installed in the print head carrier location selected by the print head cartridge selection means.

The invention also provides an ink jet printer for creating an image on a printing surface based on image data received from a host computer. The ink jet printer includes multiple ink jet print head cartridges of different types for use in a variety of different printing situations. Each of the print head cartridges has print head cartridge identification means for storing identification information concerning the type of print head cartridge. The printer has multiple print head carrier locations, each capable of receiving any one of the print head cartridges. A printer processor is connected to the print head cartridge identification means of each print head cartridge. The printer processor receives the image data from the host computer, and determines an appropriate type of print head cartridge to use to create the image on the printing surface. The printer processor also accesses the print head cartridge identification means of each print head cartridge, retrieves the identification information therefrom, and determines if the appropriate type of print head cartridge is installed in any of the print head carrier locations. The printer processor selects the appropriate print head cartridge to use to create the image if the appropriate type of print head cartridge is installed in any of the print head carrier locations, and configures the printer to use the appropriate ink jet print cartridge. The printer includes a printer memory connected to the printer processor for storing instructions that control the printer processor. The printer also includes a display connected to the printer processor for displaying an error message to a printer user if the printer processor determines that the appropriate type of print head cartridge is not installed in any of the print head carrier locations.

BRIEF DESCRIPTION OF THE DRAWINGS

Further advantages of the invention will become apparent by reference to the detailed description of preferred embodiments when considered in conjunction with the following drawings wherein.

DETAILED DESCRIPTION OF THE INVENTION

An increasing number of different types of ink jet print head cartridges are becoming available. These cartridges vary in many aspects. Some cartridges have more nozzles that are capable of producing a higher resolution image. Other cartridges are designed to contain multiple inkwells filled with different colors of ink that allow them to produce images comprised of more than one color. With the increasing variety of print head cartridges available, insuring that the right type of print head cartridge is installed in the proper location has become an increasing problem. Many different approaches have been applied to this problem in the past. One such approach is represented in FIG. 1.

Figure 1:
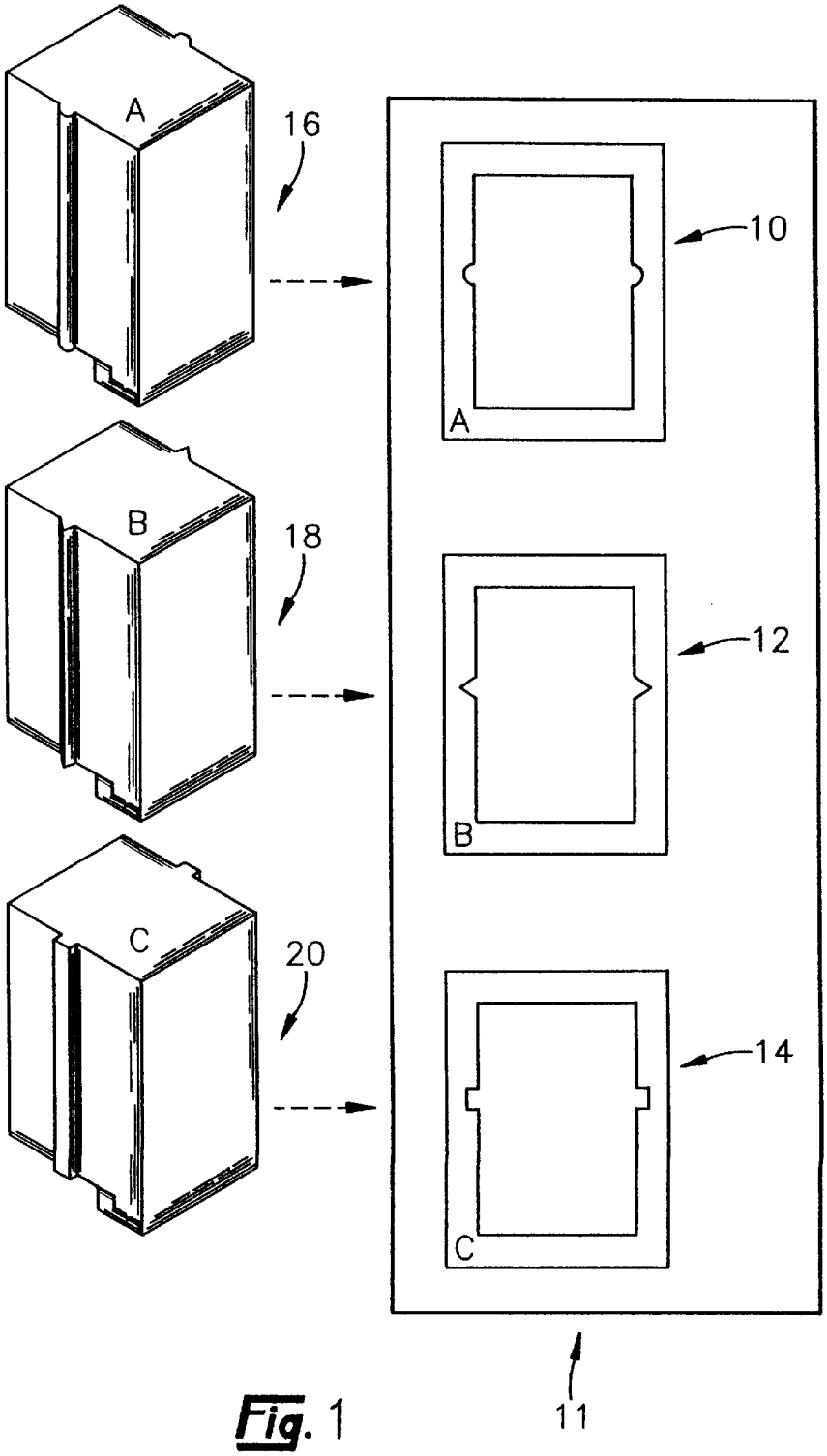
FIG. 1 is a symbolic representation of a prior art multiple print head printing scheme for insuring the correct print head cartridge is inserted in the correct print head carrier location.

FIG. 1 is a symbolic representation of the shaped print head cartridge method of insuring that the proper type of print head is installed in the proper print head carrier location. The multiple print head ink jet printer represented in FIG. 1 has three print head carrier locations 10, 12 and 14 on the print head carrier 11 for receiving the three print head cartridges 16, 18 and 20. Three print head systems are sometimes used to print with the three primary colors needed to produce a color image. In accordance with the prior art approach, each of the print head cartridges 16, 18 and 20 have a particular physical construction. Similarly, the print head carrier locations 10, 12 or 14 into which the print head cartridges 16, 18 or 20 are to be inserted have a corresponding physical construction that is keyed to match the physical construction of the appropriate type of print head cartridge 16, 18 or 20. For example, the type "C" print head cartridge 20 has a shape that is designed to fit into the type "C" print head carrier location 14 and the type "B" print head cartridge 18 is shaped to fit into the type "B" print head carrier location 12. Similarly, the round type "A" print head cartridge 16 is shaped to be received by the curved type "A" socket 10. It is understood that the letters used to refer to the different types of print head cartridges and carrier locations are exemplary and do not represent actual print head cartridge types.

Figure 2:
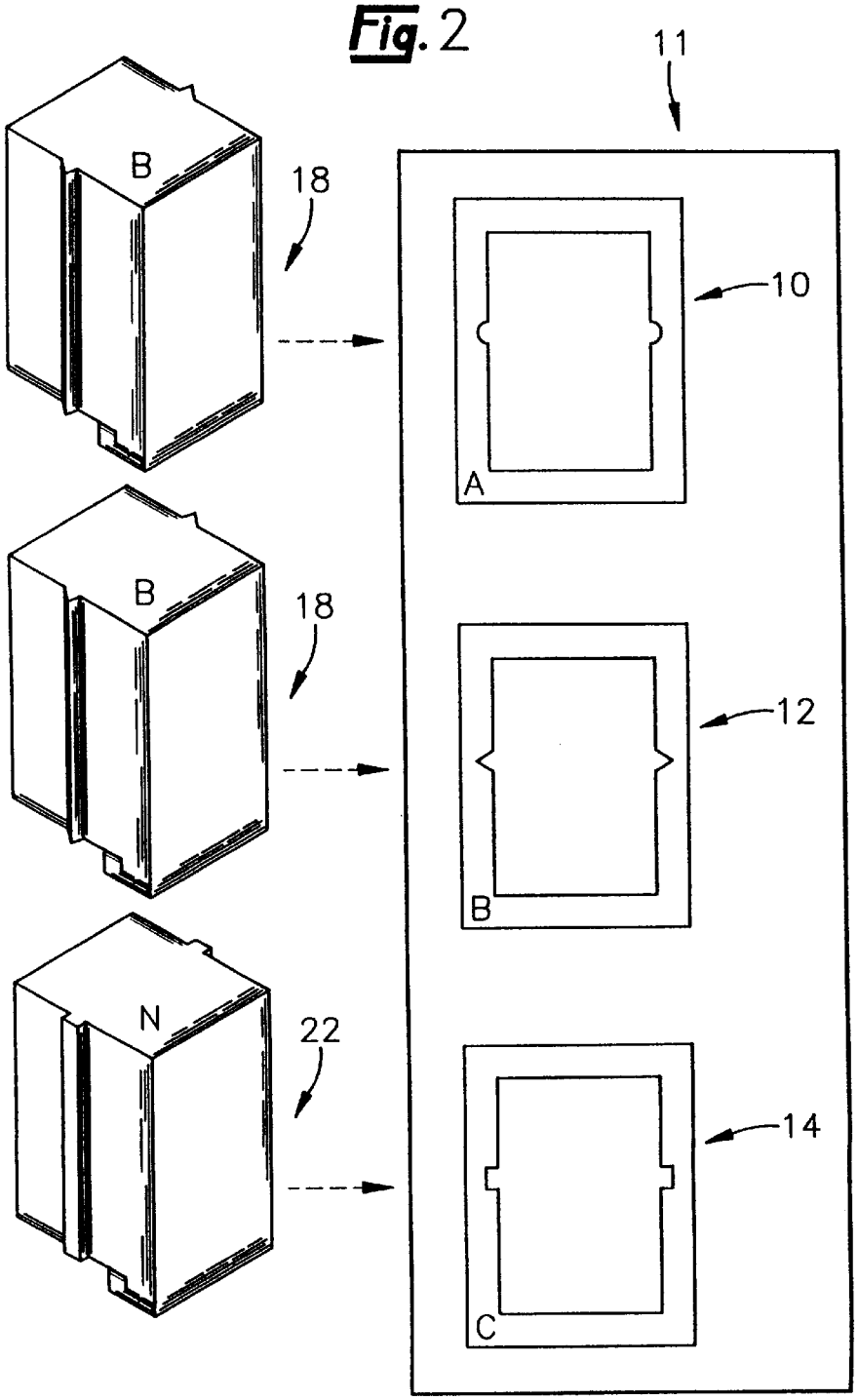
FIG. 2 is a symbolic representation of possible incorrect print head cartridge insertions according to the printing scheme of FIG. 1.

Referring now to FIG. 2, an incorrect insertion of the type "B" shaped cartridge 18 into the type "A" print head carrier location 10 is shown. When a user attempts to insert the wrong type of print head cartridge 18 into the wrong carrier location 10, the user is unable to insert the cartridge 18 because the physical dimensions of the cartridge 18 and the carrier 10 are designed to prevent insertion. Because the print head cartridge 18 does not fit in the print head carrier location 10, the user would then attempt to install the cartridge 18 in another print head carrier location 10, 12 or 14. When the user attempts to install the type "B" print head cartridge 18 into the type "B" print head carrier location 12, the print head cartridge 18 fits into the print head carrier 12 and the printer is ready for printing. Thus, the physical construction of the print head cartridges 16, 18 and 20 and the print head carrier locations 10, 12 and 14 make it virtually impossible for the user to insert the wrong type of cartridge 16, 18 or 20 into the wrong carrier location 10, 12 and 14.

The shape of the print head cartridges 16, 18 and 20 and carrier locations 10, 12 and 14 is exaggerated for the sake of simplicity. In actual multiple print head printing systems using the shaped approach of FIG. 1, the print head cartridges 16, 18 and 20 would likely have a keyed structure such as a series of corresponding posts and holes that would prevent the wrong cartridge 16, 18 and 20 from being inserted in the wrong carrier location 10, 12 and 14. However, the concept is the same, the physical dimensions of the print head cartridges 16, 18 and 20 prevent them from being inserted into the wrong print head carrier locations 10, 12 and 14.

From the printer's perspective, certain electrical and mechanical connections are made when the print head cartridge 16, 18 or 20 is inserted into a carrier location designed to receive it. These connections allow the printer to detect the presence of the print head cartridge 16, 18 or 20. Thus, if these connections are made, the printer knows that a print head cartridge has been inserted into the print head carrier location 10, 12 and 14. However, because the carrier locations 10, 12 and 14 are shaped to prevent the wrong type of print head cartridge from being inserted, the printer typically assumes that any cartridge that was able to be inserted in a print head carrier location is the proper type of print head cartridge. For example, if a print head cartridge is inserted in carrier location 14, the printer assumes the print head cartridge is a type "C" cartridge 20. If, as shown in FIG. 2, a new type "N" print head cartridge 22 is designed so that the physical dimensions and mechanical and electrical connections of the print head cartridge 22 allow it to be inserted into carrier location 14, the printer will assume the inserted type "N" print head cartridge 22 is the original type "C" cartridge 20 designed to be received in the type "C" carrier location 14. If the new print head cartridge 22 is designed to use the same host driver software as the original cartridge 20, the new cartridge will probably function. However, if the new print head cartridge 22 requires new host driver software, the new cartridge 22 will not function properly because the prior art printer assumes that any cartridge inserted into carrier location 14 is the original cartridge 20 and, thus, the printer will use the host driver software designed for the original cartridge 20. Because requiring that a newly designed print head cartridge 22 use the same host driver software as older print head cartridges 16, 18 and 20 severely limits the ability to upgrade the new print head cartridge 22, this prior art method for preventing the incorrect insertions of print head cartridges 16, 18 and 20 is not very desirable.

Figure 3:
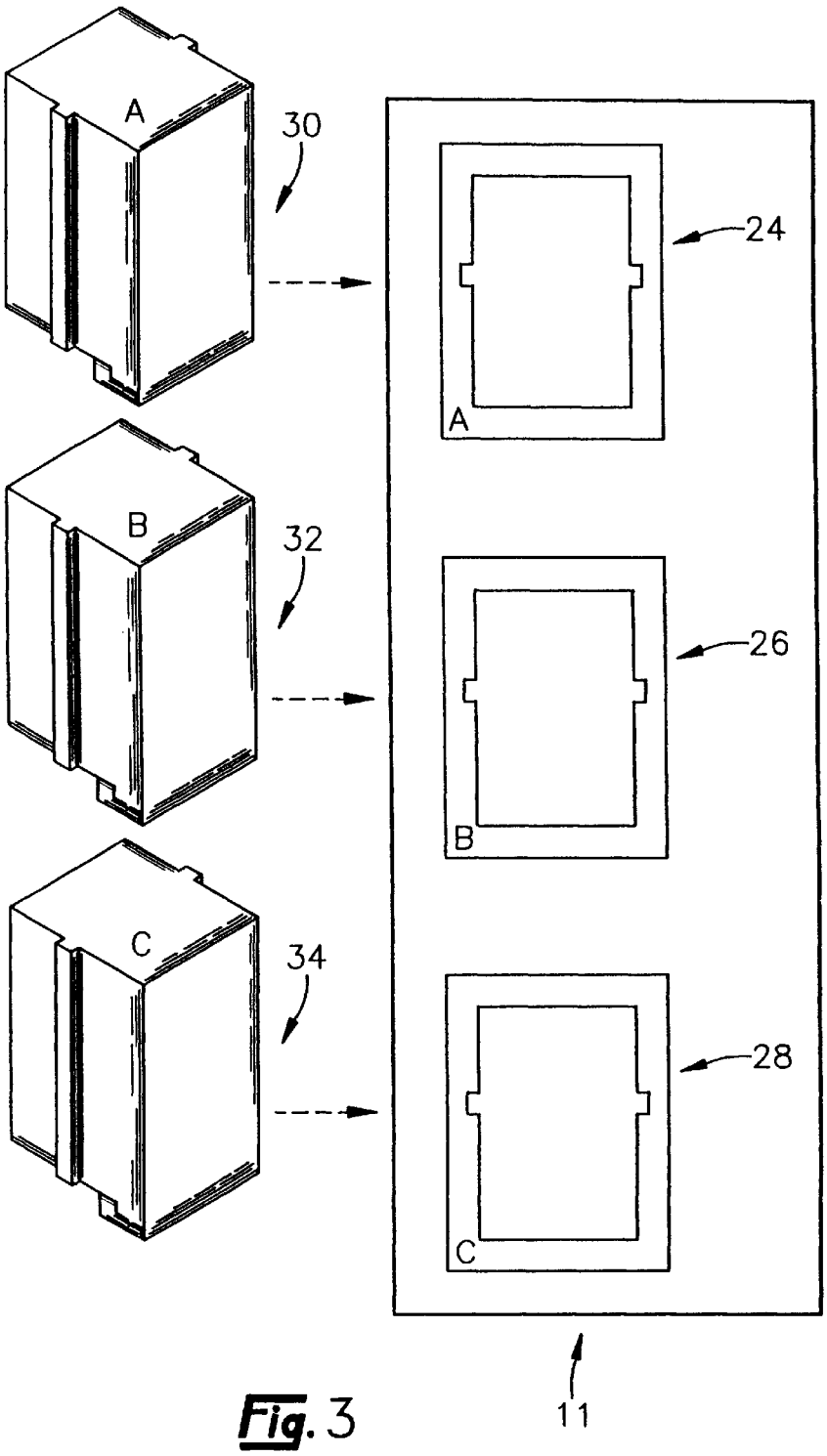
FIG. 3 is a symbolic representation of another prior art multiple print head printing scheme for insuring the correct print head cartridge is inserted in the correct print head carrier location.

Another prior art approach to operating a multiple print head printer that uses different types of print head cartridges is depicted in FIG. 3. According to this approach, each print head carrier location 24, 26 and 28 is designed to use a certain type of print head cartridge 30, 32 or 34. Instead of being shaped to only fit into the correct print head carrier location 24, 26 and 28, the print head cartridges 30, 32 and 34 in this type of system have identification information encoded upon the cartridge 30, 32 and 34. When the print head cartridge 30, 32 and 34 is inserted into a carrier location 24, 26 and 28, the printer reads the identification information encoded on the print head cartridge 30, 32 and 34. By examining the identification information, the printer can determine if the correct type print head cartridge 30, 32 and 34 is inserted into the proper print head carrier location 24, 26 and 28. When the printer is instructed to print data using a certain type of print head cartridge 30, 32 or 34, the printer checks the carrier location 24, 26 or 28 assigned to that type of cartridge and, if a proper type of print head cartridge 30, 32 or 34 is installed in the carrier location 24, 26 or 28, the printer prints the data. If the proper type of print head cartridge is not in the designated carrier location 24, 26 or 28, an error message is displayed to inform the user.

Figure 4:
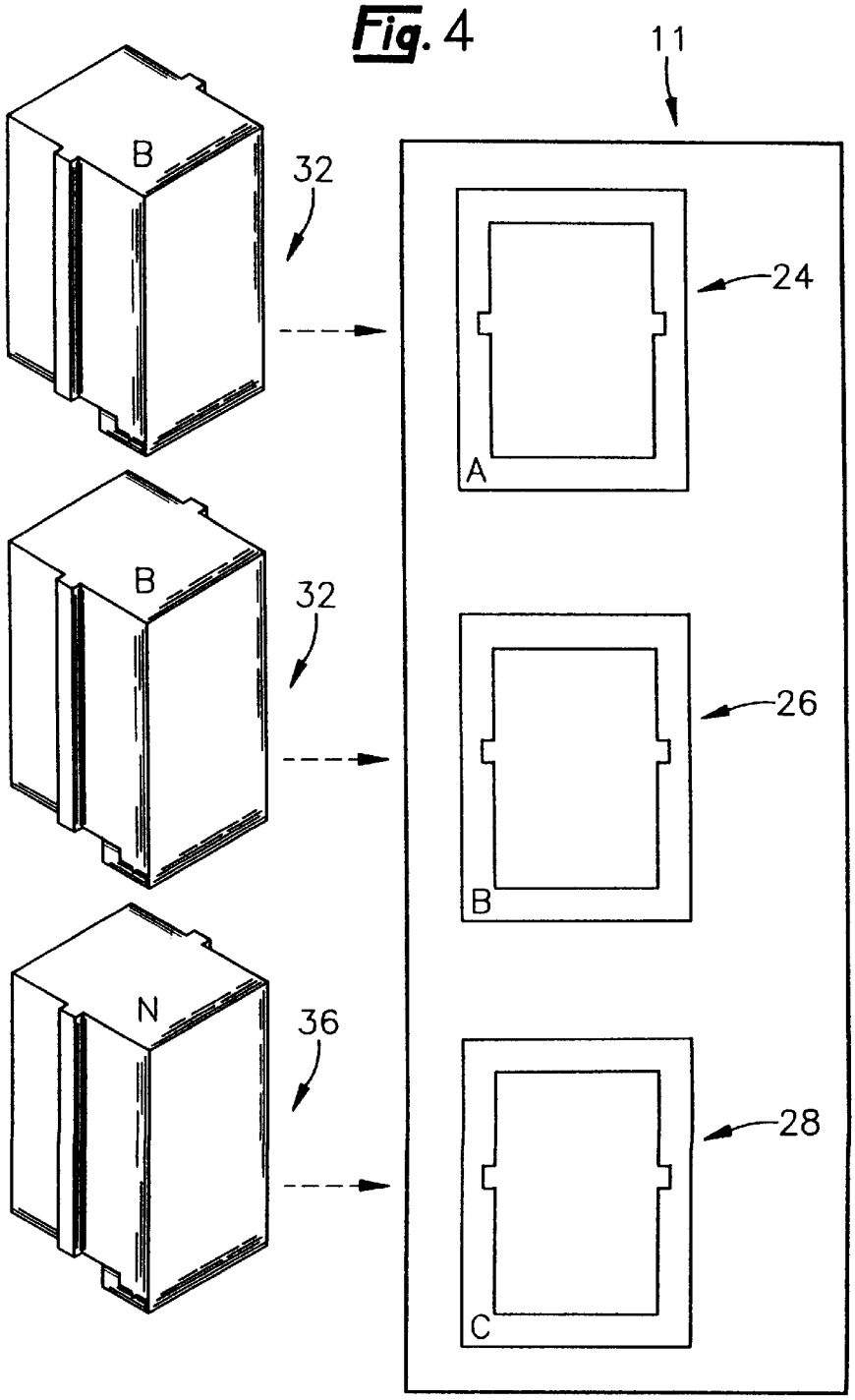
FIG. 4 is a symbolic representation of possible print head cartridge insertions according to the printing scheme of FIG. 3.

Because the physical construction of the different types of print head cartridges 30, 32 and 34 allows them to be inserted into any print head carrier location 24, 26 and 28, it is easy to insert the wrong type of print head cartridge 30, 32 and 34 into the wrong carrier location 24, 26 and 28. Referring now to FIG. 4, if the identification information indicates that a type "B" print head cartridge 32 was inserted into a type "A" carrier location 24, the printer will send an error message to the user. The user then removes the type "B" print head cartridge 32 from the type "A" carrier location 24 into which it was inserted and inserts it into another carrier location 26 or 28. The process is repeated until the type "B" print head cartridge 32 is inserted into the type "B" print head carrier location 26. If the identification information indicates that the correct print head cartridge 32 is installed in the correct carrier location 26, the host driver software associated with the carrier location 26 will attempt to print with the inserted cartridge 32.

The method of insuring correct print head cartridge insertion shown in FIGS. 3 and 4 suffers from many of the same drawbacks as the method depicted in FIGS. 1 and 2. For example, if a new type "N" print head cartridge 36 is inserted into a print head carrier location 28 that was designed to receive a type "C" print head cartridge 34, the printer electronics will examine the identification code on the new type of print head cartridge 36. If the new cartridge 36 has not been encoded with the identification code of the original print head cartridge 34 designed to be received by the carrier location 28, the printer will display an error message. If the new cartridge 36 has been encoded with the proper identification code, the printer will attempt to print with the new cartridge 36 using the driver software and printer configuration associated with the original type of print head cartridge 34. Thus, if the printer is operating according to the method of FIG. 3, any new types of print head cartridges 36 must be designed to use the driver software and printer configuration associated with the type of print head cartridge 34 the print head carrier location 28 was designed to receive. While it is possible to design a new print head cartridge 36 that will operate with the preexisting driver software, requiring that the new cartridge use preexisting host driver software severely limits the degree to which the capabilities of the new type of print head cartridge 36 can be expanded.

Figure 5:
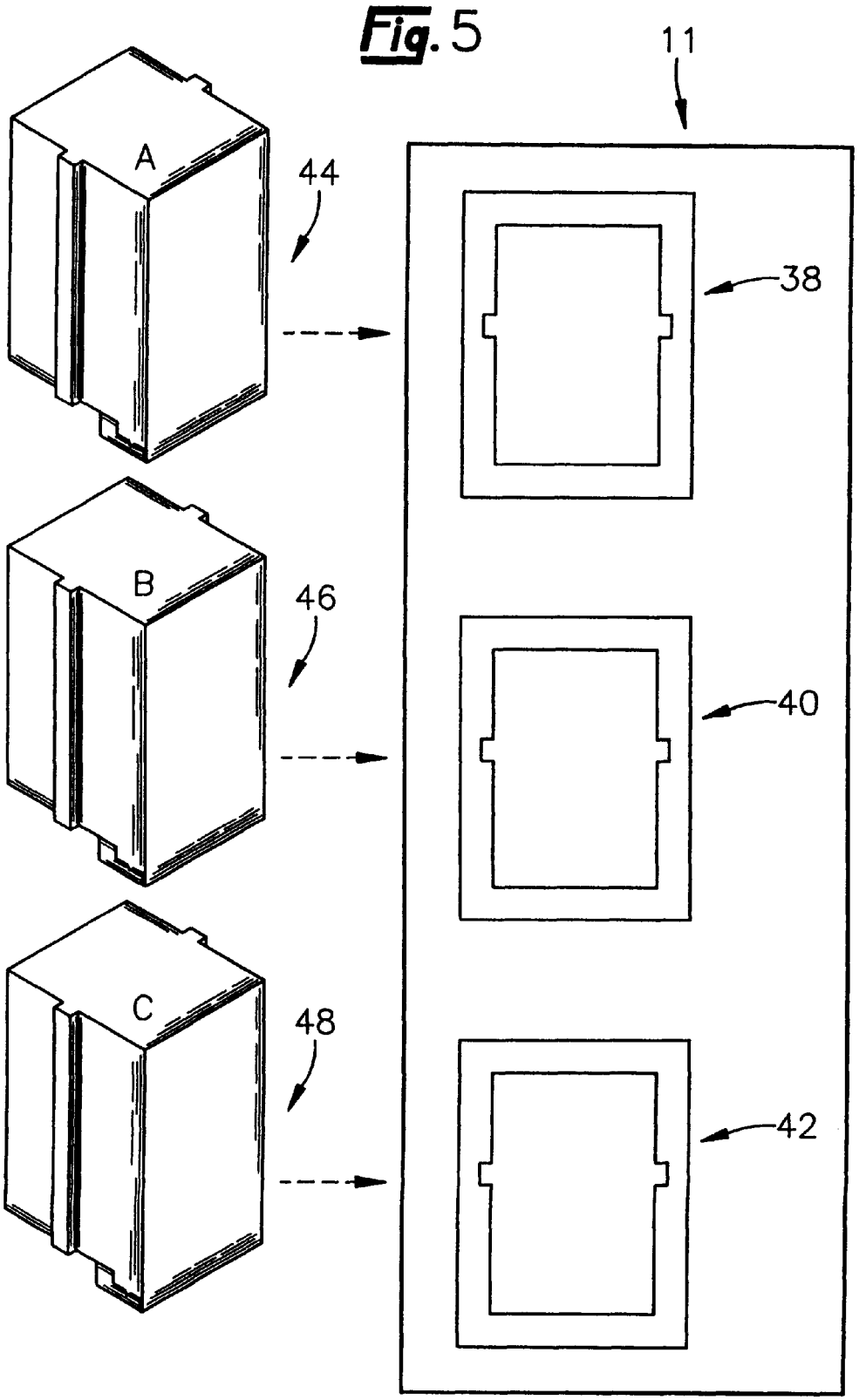
FIG. 5 is a symbolic representation of the present invention for insuring that the correct print head cartridges are inserted in a multiple print head printer.

Referring now to FIG. 5, the present invention for insuring the correct insertion of print head cartridges 44, 46 and 48 is shown. The print head carrier locations 38, 40 and 42 are designed to be functionally identical. Additionally, each of the print head carrier locations 38, 40 and 42 is constructed to physically receive a variety of different types of print head cartridges 44, 46 and 48. In a preferred embodiment of the present invention, the print head cartridges 44, 46 and 48 are installed by inserting the cartridge in any one of the print head locations 38, 40 and 42.

Image data sent to the printer by a host computer consists of header information and image information. The header information specifies characteristics such as the color and resolution of the image to be printed. The image information specifies the location of each element of the image to be printed.

When the printer receives the image data, the printer determines, based on the header information, what type of print head cartridge would be appropriate to print the image. The print head cartridges 44, 46 and 48 are encoded with identification information that can be read by the printer to identify the type of the cartridge 44, 46 or 48. When the printer determines what type of print head cartridge would be appropriate to use to print the image, the printer begins to search the identification information on the installed print head cartridges 44, 46 and 48 for a cartridge of the desired type. If the desired type of cartridge 44, 46 or 48 is located, the printer configures itself to print using the print head carrier location 38, 40 or 42 containing the desired type of print head cartridge 44, 46 or 48.

For example, assume that the print head cartridges 44, 46 and 48 have been installed in the print head carrier locations 38, 40 and 42 respectively as shown in FIG. 5. The printer receives image data from a host computer that includes header information indicating that a "C" type print head cartridge, such as cartridge 48 of FIG. 3, is the desired type of print head cartridge. The printer then accesses the identification information from print head cartridge 44, and determines that the print head carrier location 38 contains an "A" type print head cartridge 44 and does not contain the desired type "C" print head cartridge 48. The printer then accesses the identification information from print head cartridge 46 and determines that a type "B" cartridge is installed at carrier location 40. When the desired type of print head cartridge is not found in carrier location 40, the printer accesses the identification information from the print head cartridge 48 in carrier location 42. When the printer recognizes the identification information on the cartridge 48 in carrier location 42 as corresponding to the desired type "C" print head cartridge 48, the printer then configures itself to print using the "C" type print head cartridge 48 installed in carrier location 42.

The above described method for insuring that the printer uses the correct print head for a particular printing application is a substantial improvement over the prior art. A multiple print head cartridge system that requires that certain types of print head cartridges be inserted in certain print head carrier locations, as shown in FIGS. 1, 2, 3 and 4, lacks the flexibility and ease of use of the system of the present invention. The present invention allows the user of the printer to install different types of print head cartridges into any carrier location without worrying about installing the wrong type of print head cartridge in the wrong carrier location.

Figure 6:
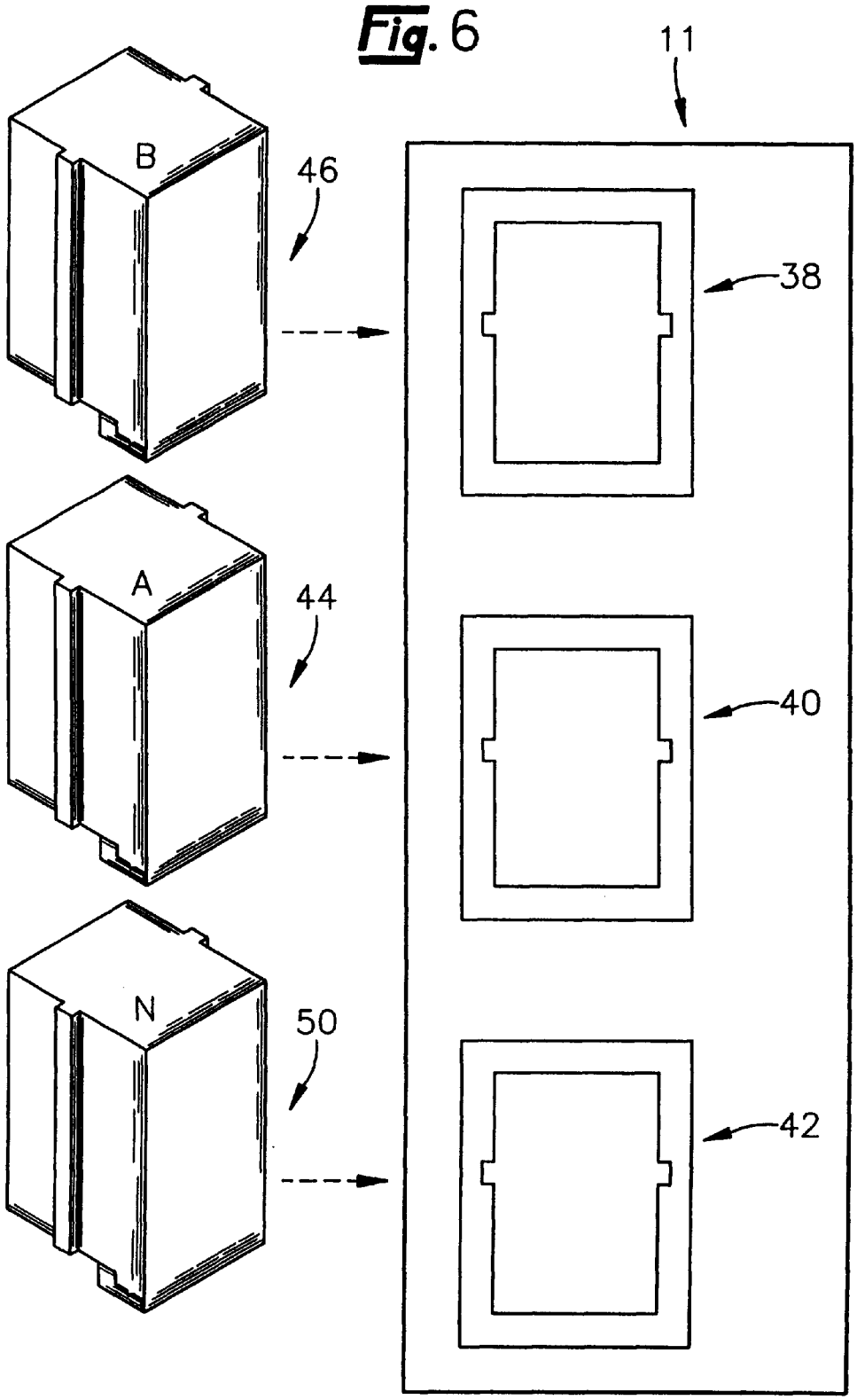
FIG. 6 is a symbolic representation of possible print head cartridge insertions in accordance with the present invention.

The advantages of the present invention can be seen from examining FIG. 6 which shows possible print head cartridge 44, 46 and 50 insertions in a printer having three print head carrier locations 38, 40 and 42. Unlike the possible insertions shown FIGS. 2 and 4, the insertions shown in FIG. 6 will all be recognized by the printer as valid insertions of the different types of print head cartridges 44, 46 and 50. For example, inserting a "B" type print head 46 into the first print head carrier location 38 will not cause an installation problem like it did in FIG. 2 and FIG. 4.

As an additional example, assume a new type "N" print head cartridge 50 is designed to be used with an ink jet printer having multiple print head carrier locations 38, 40 and 42 and operating in accordance with the present invention. When the printer receives a command telling it to print using a type "N" print head cartridge 50, the printer searches the installed print head cartridges to determine if one of them is the correct type. If an "N" type print head cartridge 50 is not installed in one of the carrier locations, the printer will display an error message indicating that no "N" type print head cartridge is available.

Yet other advantages are provided by the present system. For example, if a print head carrier location malfunctions on a multiple print head printer that requires that certain types of print head cartridges be inserted in certain carrier locations, the printer can not print using the type of print head cartridge designed for the malfunctioning print head carrier location. However, if one of the print head carriers malfunctions on a printer operating in accordance with the present invention, the cartridge, no matter what its type, can simply be installed into a functioning print head carrier location.

Figure 7:
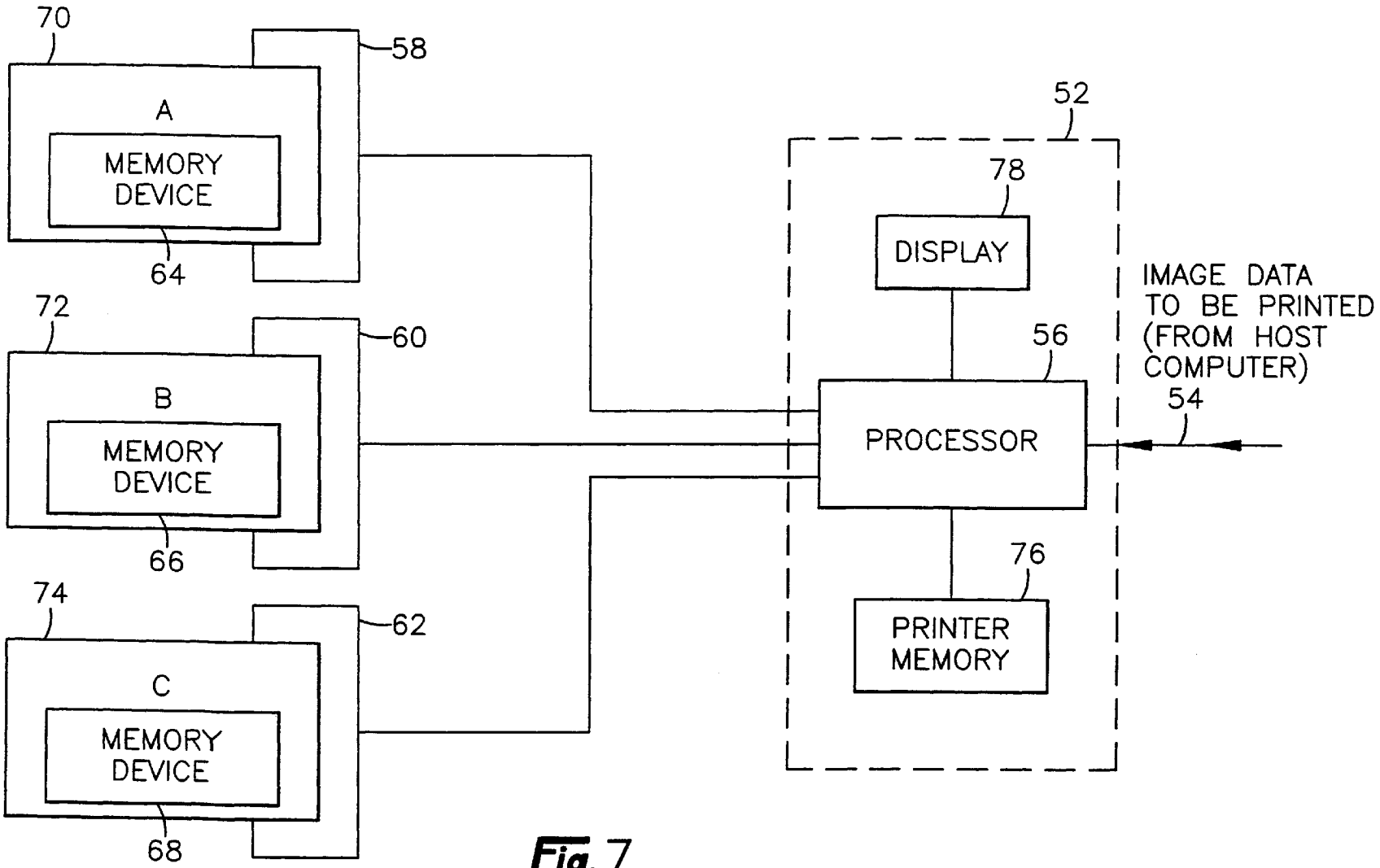
FIG. 7 is a block diagram of a preferred embodiment of the invention.

FIG. 7 is a block diagram of the electronics needed to implement a preferred embodiment of the present invention for reducing the possibility of making an incorrect print head insertion. Image data, sent by a host computer over a printer input line 54 is received by the printer electronics 52. As discussed previously, the image data contains header information specifying the type of print head cartridge to use to print the image. The printer electronics 52 include a printer processor 56 that receives the image data and determines, based on the header information, which type of print head cartridge to use to print the image. Typically, the printer processor block 56 of FIG. 7 may include a microprocessor, a digital electronics ASIC (application-specific integrated circuit), and buffer interface between the microprocessor and the memory devices 64, 66 and 68.

The printer represented in FIG. 7 has three print head carrier locations 58, 60 and 62. The print head carrier locations 58, 60 and 62 provide electrical contacts between the printer processor 56 and identification means on each cartridge, such as memory devices 64, 66 and 68 located on the print head cartridges 70, 72 and 74 respectively. The memory devices 64, 66 and 68 contain identification information that allows the processor 56 to determine the type of each print head cartridge 70, 72 and 74. The memory devices 64, 66 and 68 may also contain configuration information that the processor 56 uses to configure the printer to print with the particular print head cartridge 70, 72 and 74. Preferably, the memory devices 64, 66, and 68 are electrically-erasable programmable read-only memory (EEPROM) devices. However, it will be appreciated that a wide variety of different types of memory devices 64, 66 and 68 could be used to store the identification information in accordance with the present invention.

Once the processor 56 has received the header information specifying the type of print head cartridge to use, the microprocessor 56 examines the contents of the memory device 64 of the print head cartridge 70 installed in the first print head carrier 58 location. Typically this information would be in the form of a digital code that corresponds to a particular type of print head cartridge. For illustration purposes, assume the header information of the image data specified a type "B" print head cartridge 72. Since the identification information in the memory device 64 of the type "A" print head cartridge 70 does not correspond to a type "B" print head cartridge 72, the processor 56 next examines the identification information in the memory device 66 of the print head cartridge 72 contained in the next print head carrier location 60. As shown in FIG. 7, the print head cartridge 72 is a type "B" print head cartridge 72. Thus, when the processor 56 compares the identification information of the memory device 66 with the header information, the processor 56 identifies print head carrier location 60 as containing the desired type "B" print head cartridge 72.

After determining which location contains the desired type of print head cartridge, the processor 56 accesses the printer memory 76 to retrieve any operating parameters necessary to configure the printer to print with a type "B" print head cartridge 72. The processor 56 then configures the printer to print using a type "B" print head cartridge installed at carrier location 60.

If the desired type of print head cartridge is not installed in any of the carrier locations 58, 60, and 62, the printer processor 56 generates an error message indicating that the appropriate print head cartridge could not be located among the installed cartridges. The error message further instructs the user to install the appropriate type of printer cartridge in order to continue the printing operation. The processor sends these error messages to a display 78, such as a liquid crystal display (LCD) panel on the printer for display to a printer user.

In an alternative embodiment, each time the printer is turned on, or any time a new print head cartridge is inserted into a carrier location 58, 60, and 62, the printer processor 56 performs an inventory of the print head cartridges installed in the carrier locations 58, 60, and 62. With reference to FIG. 7, the printer processor 56 accesses the identification information stored in each of the memory devices 64, 66, and 68 and determines the print head types (A, B, or C) based on the identification information. The processor 56 then correlates the print types to their respective carrier locations, and stores this information in printer memory 76. When a host computer sends image data to the processor 56, the processor 56 accesses the printer memory 76 and determines the location of the appropriate print head cartridge type (if present) as indicated by the header information.

Having described various aspects and embodiments of the invention and several advantages thereof, it will be recognized by those of ordinary skill in the art that the invention is susceptible to various modifications, substitutions and revisions within the spirit and scope of the appended claims.

What is claimed is:

1. A method of operating an inkjet printer having multiple inkjet print head cartridges of multiple types installed at multiple inkjet print head carrier locations, each inkjet print head cartridge having a memory device disposed thereon for storing identification information indicating the type of cartridge, the method comprising the steps of:

receiving image data including header information and image information;

selecting at least one particular type of print head cartridge to use based upon the header information;

ascertaining whether any of the inkjet print head cartridges installed at the multiple inkjet print head carrier locations are of the particular type; and configuring the printer to print the image with the particular type of inkjet print head cartridge installed at the corresponding inkjet print head carrier location.

2. The method of claim 1 wherein the step of ascertaining whether any of the inkjet print head cartridges installed at the multiple inkjet print head carrier locations is of the particular type further comprises:

accessing the identification information stored in each of the memory devices; and identifying the type of print head cartridge installed at each location based upon the identification information.

3. The method of claim 1 further comprising displaying an error message if the particular type of print head cartridge is not installed in any of the print head carrier locations.

4. A method of operating an ink jet printer having multiple inkjet print head cartridges and multiple print head carrier locations for receiving the multiple ink jet print head cartridges, each inkjet print head cartridge having identification information indicating a type of cartridge, the identification information electronically stored in memory devices disposed on the cartridges, the printer electrically interfaced with a host computer and capable of receiving image data from the host computer, the method comprising the steps of:

receiving the image data including header information and image information from the host computer;

specifying at least one appropriate type of print head cartridge to use to print the image data based upon said header information;

accessing the memory devices and retrieving the identification information of the print head cartridges installed in the print head carrier locations;

determining based upon the identification information whether an appropriate type of print head cartridge is installed in any of the print head carrier locations;

displaying an error message if an appropriate type of print head cartridge is not installed in any of the print head carrier locations, and prompting a user of the printer to install a print head cartridge of an appropriate type in one of the print head carrier locations;

configuring the printer to print using an appropriate type of print head cartridge at the cartridge's print head carrier location; and printing the image data using an appropriate type of print head cartridge.

5. An inkjet printer for creating an image on a printing surface, the printer capable of interfacing with a host computer, the image based upon image data received from the host computer, the printer comprising:

print head type determination means for receiving header information from the host computer and determining at least one particular type of inkjet print head cartridge to be used in creating the image based upon the header information;

multiple ink jet print head cartridges of different types for use in a variety of different printing situations, each print head cartridge having identification means for storing identification information relating to the type of print head cartridge;

multiple print head carrier locations, each location capable of receiving any one of the inkjet print head cartridges, at least one location having one of the print head cartridges installed therein;

print head cartridge selection means for accessing the identification information, determining the type of print head cartridge installed in each print head carrier location based on the identification information, and selecting a print head carrier location having a print head cartridge of the particular type installed therein; and printer configuration means for configuring the printer to use the print head cartridge installed in the print head carrier location selected by the print head cartridge selection means to create the image on the printing surface.

6. The ink jet printer of claim 5 further comprising:

the print head cartridge selection means for generating an error message when a print head cartridge of the particular type is not installed in any of the print head carrier locations, the error message prompting a printer user to install the particular type of print head cartridge into one of the carrier locations; and display means for displaying the error message to the printer user.

7. An ink jet printer for creating an image on a printing surface based on image data received from a host computer, the ink jet printer comprising:

multiple ink jet print head cartridges of different types for use in a variety of different printing situations, each print head cartridge having print head cartridge identification means for storing identification information concerning the type of print head cartridge;

multiple print head carrier locations, each capable of receiving any one of the print head cartridges; and a printer processor connected to the print head cartridge identification means of each print head cartridge, the printer processor for receiving the image data from the host computer, for determining an appropriate type of print head cartridge to use to create the image on the printing surface based upon header information received with said image data, for accessing the print head cartridge identification means of each print head cartridge and retrieving the identification information therefrom, for determining if the appropriate type of print head cartridge is installed in any of the print head carrier locations, for selecting the appropriate print head cartridge to use to create the image on the printing surface if the appropriate type of print head cartridge is installed in any of the print head carrier locations, and for configuring the printer to use the appropriate ink jet print cartridge.

8. The ink jet printer of claim 7 further comprising a printer memory connected to the printer processor for storing instructions that control the printer processor.

9. The ink jet printer of claim 7 further comprising a printer memory connected to the printer processor for storing parameters used to configure the printer to print using the appropriate print head cartridge.

10. The ink jet printer of claim 7 further comprising a display connected to the printer processor for displaying an error message to a printer user if the printer processor determines that the appropriate type of print head cartridge is not installed in any of the print head carrier locations.

11. The ink jet print printer of claim 10 wherein the printer further comprises:

the printer processor for generating a message that prompts the printer user to install the appropriate type of print head cartridge if the printer processor determines that the appropriate type of print head cartridge is not installed in any of the multiple print head carrier locations; and the display for displaying the message to the printer user.

* * * * *